US010845176B2

(12) United States Patent
Schmitz

(10) Patent No.: US 10,845,176 B2
(45) Date of Patent: Nov. 24, 2020

(54) MUNITION MODULE, WARHEAD AND MUNITION

(71) Applicant: DIEHL DEFENCE GMBH & CO. KG, Ueberlingen (DE)

(72) Inventor: Benjamin Schmitz, Roethenbach an der Pegnitz (DE)

(73) Assignee: Diehl Defence GmbH & Co. KG, Ueberlingen (DE)

( * ) Notice: Subject to any disclaimer, the term of this patent is extended or adjusted under 35 U.S.C. 154(b) by 0 days.

(21) Appl. No.: 16/427,428

(22) Filed: May 31, 2019

(65) Prior Publication Data

US 2019/0316890 A1 Oct. 17, 2019

Related U.S. Application Data

(63) Continuation of application No. PCT/EP2017/001391, filed on Nov. 29, 2017.

(30) Foreign Application Priority Data

Dec. 16, 2016 (DE) ..... 10 2016 015 042

(51) Int. Cl.
*F42C 19/08* (2006.01)
*F42B 12/20* (2006.01)

(52) U.S. Cl.
CPC ..... *F42C 19/0807* (2013.01); *F42B 12/207* (2013.01); *F42C 19/0838* (2013.01)

(58) Field of Classification Search
CPC . F42B 12/207; F42C 19/0807; F42C 19/0838
(Continued)

(56) References Cited

U.S. PATENT DOCUMENTS 2,780,995 A 2/1957 Migliaccio
3,404,532 A 10/1968 Olstein
(Continued)

FOREIGN PATENT DOCUMENTS

DE 2555649 A1 6/1977
DE 2747932 A1 5/1978
(Continued)

OTHER PUBLICATIONS

Diehl BGT Defense GMBH & Co. KG: Insensitive Infantry Ammunition 40mm×53 High Velocity with self-destruct function, D-PR/03/2013.

(Continued)

*Primary Examiner* — Bret Hayes
(74) *Attorney, Agent, or Firm* — Laurence A. Greenberg; Werner H. Stemer; Ralph E. Locher

(57) ABSTRACT

A munition module includes an ignition point of an explosive configuration positioned away from a detonator within a casing of the explosive configuration. In an initial state, an ignition channel runs from the detonator to the ignition point. The ignition channel is formed so as to be open in an initial state and self-sealing in an exploded state after a detonation has taken place. A warhead with the munition module contains an active covering which at least partially surrounds the explosive configuration and can be accelerated by the reacted explosive. In a munition having the warhead, the detonator is an impact detonator. A munition in the form of an air-burst munition contains the warhead.

14 Claims, 6 Drawing Sheets

(58) Field of Classification Search
USPC ..... 102/202
See application file for complete search history.

(56) References Cited

U.S. PATENT DOCUMENTS

| | | | | |
|---|---|---|---|---|
| 3,713,392 | A | 1/1973 | Parsons | |
| 3,789,764 | A | 2/1974 | Stresau et al. | |
| 3,831,522 | A | 8/1974 | Romney | |
| 4,038,900 | A * | 8/1977 | Lopez | F42D 1/04 89/1.14 |
| 4,516,501 | A * | 5/1985 | Held | F42B 12/22 102/275.5 |
| 4,664,033 | A * | 5/1987 | Burkdoll | C06C 7/00 102/275.11 |
| 4,762,068 | A | 8/1988 | Luebbers | |
| 5,189,248 | A | 2/1993 | Deffayet et al. | |
| 5,509,357 | A | 4/1996 | Lawther | |
| 5,689,083 | A * | 11/1997 | Hadden | C06C 5/06 102/275.11 |
| 6,578,488 | B2 | 6/2003 | Strauss et al. | |

FOREIGN PATENT DOCUMENTS

| | | | |
|---|---|---|---|
| DE | 3341459 | A1 | 5/1985 |
| DE | 3507643 | A1 | 9/1986 |
| DE | 3606762 | A1 | 9/1987 |
| DE | 3028933 | C1 | 11/1989 |
| DE | 3827784 | A1 | 3/1990 |
| DE | 9013576 | U1 | 1/1991 |
| DE | 19544784 | A1 | 6/1997 |
| DE | 29705355 | U1 | 8/1997 |
| DE | 19612890 | A1 | 10/1997 |
| DE | 19651169 | A1 | 6/1998 |
| DE | 19711575 | A1 | 9/1998 |
| DE | 69129815 | T2 | 12/1998 |
| DE | 19753187 | A1 | 5/1999 |
| DE | 69605539 | T2 | 4/2000 |
| DE | 10031301 | A1 | 1/2002 |
| DE | 10116669 | A1 | 10/2002 |
| DE | 202009015942 | U1 | 4/2010 |
| DE | 102012006429 | A1 | 10/2013 |
| FR | 2617955 | A1 | 1/1989 |
| GB | 217955 | A | 6/1924 |
| GB | 1085045 | A | 9/1967 |
| GB | 1601917 | A | 11/1981 |
| RU | 2056617 | C1 | 3/1996 |
| RU | 2224970 | C2 | 2/2004 |
| RU | 2253832 | C2 | 6/2005 |
| RU | 2520191 | C1 | 6/2014 |

OTHER PUBLICATIONS

Diehl Defence, Insensitive Infanteriemunition [insensitive infantry munition] 40 mm×53 High Velocity, http:// www.diehl.com / fileadmin / diehl-defence / user_upload / flyer / Patronen [cartridges]_ 40_mm_x_53.pdf.

* cited by examiner

MUNITION MODULE, WARHEAD AND MUNITION

CROSS-REFERENCE TO RELATED APPLICATION

This is a continuation application, under 35 U.S.C. § 120, of copending International Application PCT/EP2017/001391, filed Nov. 29, 2017, which designated the United States; this application also claims the priority, under 35 U.S.C. § 119, of German Patent Application DE 10 2016 015 042.4, filed Dec. 16, 2016; the prior applications are herewith incorporated by reference in their entirety.

BACKGROUND OF THE INVENTION

Field of the Invention

The invention relates to a munition module, a warhead with a munition module and a munition with a warhead.

A munition of that type requires an explosive and a detonator. For example, the "Sprengsplitter [explosive fragmenter] DM121 IM" cartridge type is known from "Diehl Defence, Insensitive Infanteriemunition [insensitive infantry munition] 40 mm×53 High Velocity, www.diehl.com/fileadmin/diehl-defence/user_upload/flyer/Patronen [cartridges]_40_mm_×_53.pdf'. The warhead contained therein is detonated by using a nose fuze, which makes the explosive react.

SUMMARY OF THE INVENTION

It is accordingly an object of the invention to provide a munition module, a warhead and a munition, which overcome the hereinafore-mentioned disadvantages of the heretofore-known devices of this general type and which provide an improved munition.

With the foregoing and other objects in view there is provided, in accordance with the invention, a munition module which contains an explosive configuration, i.e. an explosive in a specific geometrical or spatial configuration or distribution. The munition module contains a detonator. The explosive configuration or the explosive can be detonated by the detonator. The detonator is disposed or aligned in relation to the explosive configuration in such a way that, in the case of a detonation, it ignites at an ignition point. The ignition point is consequently a specific location of the explosive configuration at which it is detonated by the detonator. The ignition point is positioned at a location within a casing of the explosive configuration, that is to say not on the surface of the casing. The location is remote from the detonator. The casing contains the entire explosive and also gaps, indentations and recesses in the explosive configuration. It is a surface area which at all points has a planar or convex extent. It is also possible that, at least at some points, it has a concave extent, for example in the case of notch charges in the shell.

In an initial state, an ignition channel runs from the detonator to the ignition point. The ignition channel is surrounded at least by part of the explosive configuration. The ignition channel is formed as a channel that is open in the initial state. The initial state is a state before the beginning of a detonation of the munition module or of the explosive. In an exploded state, which occurs after detonation of the explosive has taken place, the channel is self-sealing. "Sealing" means in particular closing or sealing at least part of the ignition channel. "Self-sealing" means that the sealing of the ignition channel takes place automatically or inevitably after the detonation due to the reaction of the explosive. Before the detonation, the ignition channel is therefore open and after detonation has taken place the channel is sealed, that is to say at least partially closed. The detonation of the explosive by the detonator takes place either directly (the detonator detonates the explosive configuration) or indirectly (the detonator detonates a lead relay and the lead relay detonates the explosive configuration). "Within the casing" means that the ignition point does not lie on the surface of the casing of the explosive configuration that is in particular facing the detonator, but rather lies inside (in particular deep inside) the casing, in particular in the region of the geometrical center or in a region beyond the center of the explosive configuration, opposite from the detonator. The exploded state is in particular the state when part of the explosive has already reacted, but part has not yet reacted. Then, a munition shell has generally expanded, but is still intact, so that a pressure buildup inside the munition is still underway. This pressure buildup is used in particular for sealing the ignition channel.

The invention is based on the observation that a warhead is detonated for example by using a nose fuze, which directly makes the explosive react. There is consequently only a minor effect in the direction of impact, for example of a grenade. The use of a self-sealing ignition channel within the warhead produces an ignition point remote from the detonator side. This ignition channel avoids the loss of power by becoming self-sealing after the detonation of the warhead and prevents the escape of explosion fumes. Fumes are caused during the reaction of the explosive from a solid to a gas. The energy serves for accelerating the main charge. The self-sealing ignition channel allows an optimum ignition point of the warhead to be chosen, without at the same time losing power due to an appreciable pressure loss during the warhead reaction. According to the invention, it is made possible that a warhead can be detonated as desired, without a decrease in power due to a premature escape of the explosion fumes having to be expected. The invention allows this to be implemented without having to resort to in-line detonating devices, such as for example EFIs (Exploding Foil Initiators, which additionally have to be electrically detonated with high energy). According to the invention, the detonation can be implemented without electrical energy. According to the invention, an effect in the direction of the detonator (in particular a fragmenting effect, not a hollow charge) can be achieved with a warhead, without using a SAD (Safety and Arming Device) outside the detonator.

In a preferred embodiment, in the exploded state the ignition channel is at least partially closed or sealed by at least one sealing element. The sealing element has been introduced into the ignition channel by the at least partially reacted explosive (in particular its pressure effect). The sealing element is therefore a device for sealing or at least partially closing the ignition channel or a (detonator-side) ignition channel opening. A corresponding sealing element allows the ignition channel to be sealed or closed particularly effectively. The sealing element may be a multipart element, or multiple sealing elements may be present in the munition module or else be combined, each bringing about a sealing of the ignition channel or the elements acting together to produce the sealing.

In a preferred variant of this embodiment, the sealing element is formed by a body which in the initial state has an initial form. In the exploded state, the body has been deformed into a closed form. At least part of the deformed body is the sealing element. Alternatively or additionally, in the initial state the body does not lie in the ignition channel and is introduced—in the initial form or in the closed form or an intermediate state—into the ignition channel by the at least partially reacted explosive in order to seal it. The body may therefore also only be brought into the ignition channel by the at least partially reacted explosive, in order to ensure that at least part of the body in the undeformed form or in some other form forms the sealing element. Thus, a sealing element in the form of a body may be provided in the munition module and then brought into the ignition channel by the reaction of the explosive in order to seal it. Particularly effective and simple sealing of the ignition channel is possible in this way.

In a preferred variant of this embodiment, the body in the initial form is a shell surrounding the ignition channel. The shell is in particular a case, a tube or a liner of the ignition channel, for example in the form of a lateral surface of a circular cylinder. Since the shell surrounds the ignition channel and the ignition channel in turn is surrounded by the explosive, the reaction of the explosive leads to a compression of the shell, and consequently to a deformation of the body to form the sealing element. Particularly effective and simple sealing of the ignition channel is achieved in this way.

In a preferred variant of this embodiment, the body is a metal body. In the case of an explosive action, the metal behaves rather like a liquid, and consequently can be deformed particularly easily. The metal is in particular a relatively soft metal, for example copper.

In a preferred embodiment, the ignition channel in the initial state is an unfilled cavity. The cavity is therefore merely filled with air or a protective gas or the like, but is unfilled with respect to other materials. Such an ignition channel is particularly suitable for use with flyer-forming detonators, with the ignition channel then being the flying channel for the flyer from the detonator to the ignition point.

In a preferred variant of this embodiment, the detonator is therefore a flyer-forming booster detonator. The ignition channel is then a flyer channel. A lead relay for detonating the explosive configuration is then disposed at the end of the ignition channel opposite from the detonator. During the detonation, the flyer therefore passes through the unfilled cavity of the ignition channel to the lead relay, in order to ignite it, with the lead relay serving for the detonation of the explosive. Such a configuration can be implemented particularly easily, since it is especially possible for "long" ignition channels to be realized, and thus the ignition point can be chosen to be particularly "deep" within the explosive configuration, that is to say far away from the detonator.

In an alternative embodiment, the ignition channel in the initial state is not an unfilled cavity, but contains a pyrotechnic material. After the detonation of the explosive configuration, the pyrotechnic material has been converted into a residual material. The pyrotechnic material allows in particular the detonation to be transferred from the detonator to the ignition point.

In a preferred variant of this embodiment, the sealing element is formed by at least part of the residual material. In particular, a sealing element may for example take the form of a compressed metal tube, which is then also combined with the residual material as a further sealing filling, in order to achieve particularly effective sealing of the ignition channel.

In a preferred embodiment, the residual material is slag. Slag is particularly well-suited for forming a corresponding sealing element.

With the objects of the invention in view, there is also provided a warhead which contains a munition module with a detonator and with an explosive configuration that can be detonated by the detonator. The warhead also contains an active covering, which at least partially surrounds the explosive configuration. The active covering can be accelerated by the reacted explosive. The munition module is a munition module according to the invention. The detonator is in particular a nose fuze. The warhead and at least some of its embodiments and respective advantages have already been explained analogously in connection with the munition module according to the invention. Consequently, a munition with which the active covering is also accelerated in the direction of the detonator through the sealed ignition channel is obtained. In the case of a nose fuze, this is for example an effect that is obtained in the direction of flight or impact of the munition.

In a preferred embodiment, the active covering is a fragmenting covering. Thus, particularly effective warheads with a fragmenting effect in the direction of the detonator can be produced.

In a preferred embodiment, at least part of the active covering is provided on the side of the explosive configuration that is facing the detonator. By virtue of the invention, this active covering is also accelerated sufficiently to take effect (in the direction of the detonator). Thus, a desired effect of the warhead, in particular in the direction of the detonator—as seen from the explosive configuration—can be achieved with the aid of the active covering. Thus, in particular a nose-side effect, in particular a fragmenting effect, can be achieved in the direction of impact of a warhead with a nose fuze.

With the objects of the invention in view, there is furthermore provided a munition which contains a warhead and an impact detonator. The warhead is a warhead according to the invention. The detonator of the warhead is the impact detonator. The munition and at least some of its embodiments and also the respective advantages have already been explained analogously in connection with the warhead according to the invention and the munition module according to the invention. Thus, a munition with an effect in the direction of impact is especially obtained.

The object of the invention is also achieved by a munition in the form of an air-burst munition, with a warhead, in which the warhead is a warhead according to the invention. In the case of the warhead according to the invention, an effect also in the direction of the detonator is possible. An effect in other directions is in any case conventionally implementable. Thus, air-burst munition with a 360-degree all-round effect can be created. The munition and at least some of its embodiments and also the respective advantages have already been explained analogously in connection with the aforementioned munition according to the invention, the warhead according to the invention and the munition module according to the invention.

The invention is based on the following realizations, observations or considerations. The embodiments referred to below are for simplicity sometimes also referred to as "the invention." The embodiments herein may also contain parts or combinations of the aforementioned embodiments or correspond thereto and/or, if appropriate, also include embodiments not mentioned heretofore.

The invention is based on the realization that it is often the case in practice that a nose fuze is used for munition and an adequate effect is not generated in the frontal direction. Therefore, the ignition mechanism for a spherical output is explained below by the example of a nose fuze. However, this can be implemented for any type of detonator (for munition this will, however, generally be a nose fuze or tail fuze because of the rotational symmetry). The aim is to achieve an effect in the direction of the detonator (in particular a fragmenting effect, not a hollow charge) with a warhead, without using a safety and arming device outside the detonator. It has previously been the practice—in particular in the case of a classic munition—to generally dispense with the effect in the direction of the detonator (or to accept significant losses in power).

The invention is based on the observation that the explosive is detonated directly on the detonator side. As a consequence of this, fumes escape and the detonation wave propagates in the wrong direction. For example, the known munition DM121 dispenses completely with front fragmentation. The invention is based on the concept that the explosion fumes can only leave the warhead, for example a grenade, after acceleration of the active covering (generally fragments), since there is otherwise a loss of pressure, and consequently a loss of power (in the energy transfer). The detonation wave must propagate in the desired direction of effect.

The invention is based on the concept of providing the ignition point sufficiently deep within the warhead. A self-sealing ignition channel is proposed as a solution. In the explosive or warhead there is a channel, at the end of which the warhead is detonated (for example by a lead relay with the aid of a flyer). Lining the channel with a relatively soft metal (for example copper) has the effect that the detonation wave in the explosive closes the channel, so that on one hand no detonation fumes can escape and on the other hand the detonation wave can act on all the effective surfaces (in particular in the direction of the detonator). Consequently, in the desired case an effective action in all directions is achieved. The ignition channel with a (metal) liner is necessary, since there is otherwise a premature escape of fumes, and consequently a drop in pressure. The detonation principle does not necessarily require a hollow ignition channel that has to be overcome with a flyer. It is equally possible that it is for example filled with a pyrotechnic material or the like (known as slag sealing).

The invention can be applied to fragmentation grenades with "powerful" fragments in the front region, for example a grenade to be used against vehicles, with fragments of a performance category that can for example completely attack the interior of a pickup truck. The invention can also be applied to air-burst grenades (in particular a 40 mm air-burst): a warhead that has a spherical range of action is very desirable in the case of an airburst grenade, since it can be used to attack an area very effectively. By contrast with a munition that is currently available, there are no ineffective regions. In comparison with a warhead with a self-sealing ignition channel, without this construction there is a premature escape of fumes and the active covering (in this case fragments) cannot be correspondingly accelerated. That has the consequence that a large part of the explosive energy is no longer available for the (front) fragments. By contrast with this, the pressure chamber is still intact thanks to the self-sealing channel. The warhead still has to break up and the explosive energy can still accelerate the fragments.

The concept of the invention is therefore to achieve a frontal effect for a 40 mm warhead that is detonated by using a nose fuze, without using a safety and arming device outside the detonator, that is feasible both technically and in terms of cost. The self-sealing ignition channel has the effect of providing an ignition point remote from the tip of the warhead. Fragments can also be accelerated under the detonator. The 40 mm 360-degree warhead can produce fragments in every direction, by contrast with previous warheads of a munition, which for the most part had to dispense with any output in the direction of the detonator. According to the invention, a construction for a (40 mm) grenade that makes a spherical effect possible is obtained. In spite of the nose fuze, targets can be attacked with fragments in the direction of flight. According to the invention, the aim is to obtain a 40 mm warhead that is intended to eliminate a weakness of the currently available fragmentation munition (HE and HE-PFF, High Energy Pre Formed Fragments). That is in particular the inadequate fragmenting effect in the front region, where the nose fuze is provided. According to the invention, standard shells that are also used for other 40 mm projectiles can be used. According to the invention, spherically distributed fragments are obtained, without angular regions that are not covered (360-degree fragmenting effect), in particular in the direction of flight and impact of the grenade. The invention makes a much greater proportion of standard components possible, which lowers the production costs.

The 360-degree fragmenting range offers two advantages for tactical deployment scenarios: fragments in the front region can be used in particular against light and unarmored vehicles in order to attack the occupants. A typical scenario would be a pickup truck. The current munition would in this case direct all of the fragments away from the target object. For air-burst munition, a 360-degree fragmenting effect is a great advantage, since the projectile does not impact on an object but is generally activated in the air. By contrast with the previously available warheads, the warhead presented in this case would act with fragments in all directions, and consequently attack a much greater area per shot fired on the battlefield. This has the consequence of a much greater effect per shot fired and a lesser effectiveness of cover taken by the enemy. Previously, it was necessary in the case of 40 mm munition to dispense with the fragmenting effect in the direction of the detonator.

In this respect, the starting point of the invention is the realization that 40 mm grenades dispense with the fragmenting effect in the direction of the detonator and thus cannot attack targets in all directions. The aim of the invention is therefore to construct a 40 mm warhead that has a 360-degree fragmenting effect, in particular a fragmenting effect in the firing direction, without changing the basic construction. The explosion fumes may only leave the warhead after the acceleration of the active covering (generally fragments), since there is otherwise a loss of pressure, and consequently a loss of power (in the energy transfer). The detonation wave should propagate in the desired direction.

According to the invention, the warhead has in particular a lead relay (for example of HNS, hexanitrostilbene) that is detonated by using a flyer-forming booster. The lead relay detonates the main charge. The detonation wave has the effect that the flying channel of the flyer is closed by the self-sealing ignition channel, so that the power of the warhead in the direction of the detonator is not lost and is available for the acceleration of the fragments. Fragments are accelerated away from the grenade in all directions.

Consequently, apart from a small amount of fumes that leave the ignition channel during the sealing, almost the entire energy of the explosive is available for the acceleration of the fragments up until the time directly before the rupturing of the shell of the warhead. The invention can be used in particular for a 40 mm 360-degree fragmentation warhead for an HE-PFF munition with an impact detonator. In this case, the fragments in the front region are intended to attack the target on which they impact. The invention may also be used for a 40 mm 360-degree fragmentation warhead for an HE-PFF munition with air-burst munition.

The invention is based on the realization that currently the 40 mm warheads dispense with any appreciable fragmenting effect in the direction of the detonator.

Therefore, according to the invention, the explosion point in an explosive configuration (in particular as seen from the detonator) is moved "to the rear" or into the center, and at least it does not remain "at the front." The ignition of the explosive takes place by a pressure wave. The pressure wave then propagates "forward."

Therefore, according to the invention, a device for closing the ignition channel opening is obtained. According to the invention, an ignition mechanism for a warhead effect in the direction of the detonator is obtained. The invention provides an ignition mechanism which makes it possible to generate a powerful effect in the direction of the detonator. This relates to the effect of warheads and grenades in principle. The invention describes an ignition mechanism which makes it possible to achieve a uniform spherical effect.

According to the invention, in particular a 40 mm 360-degree fragmentation warhead is obtained. The invention describes in particular a 40 mm warhead which, in spite of a nose fuze, has a powerful frontal effect and a spherical effect.

Other features which are considered as characteristic for the invention are set forth in the appended claims.

Although the invention is illustrated and described herein as embodied in a munition module, a warhead and a munition, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
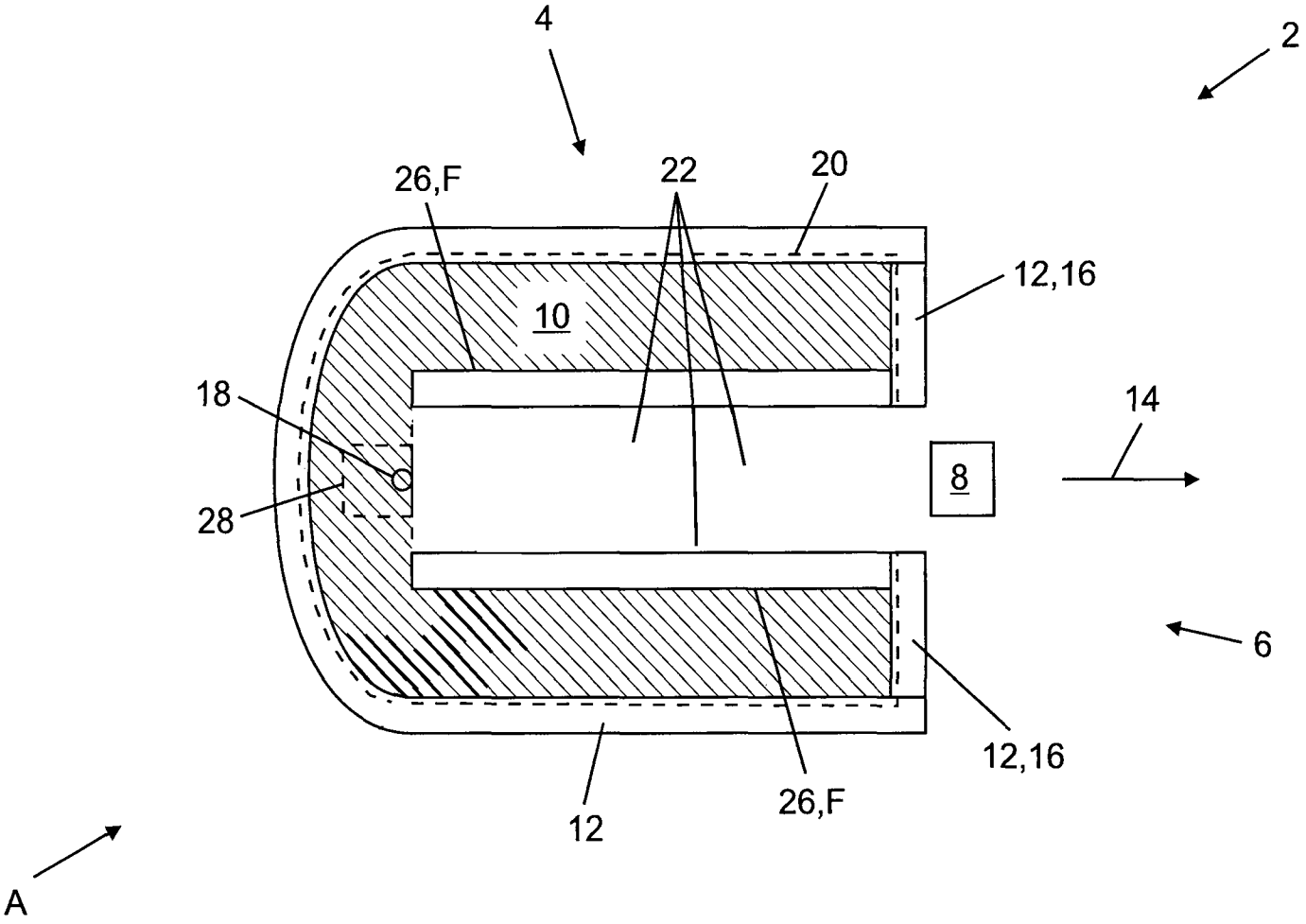
FIG. 1 is a diagrammatic, longitudinal-sectional view of a munition with a detonator in an initial state

Referring now to the figures of the drawings in detail and first, particularly, to FIG. 1 thereof, there is seen a part of a munition 2, in which the munition is a 40 mm fragmentation grenade. The munition 2 contains a warhead 4. The warhead 4 contains a munition module 6 with a detonator 8 and an explosive configuration 10 that can be detonated by the detonator 8. The explosive configuration 10 is represented by hatching. The warhead 4 also contains an active covering 12, which surrounds the explosive configuration 10 and which can be accelerated by reacted explosive of the explosive configuration 10, or which is accelerated in the case of detonation.

The detonator 8 in the present case is a nose fuze, since it is located (in the case of deployment) "before" the explosive configuration 10, or in this sense at the "nose" of the munition 2 with respect to a direction of flight 14 of the munition 2. The active covering 12 is a fragmenting covering in which a part 16 of the active covering 12 is provided on the side of the explosive configuration that is facing the detonator 8.

The detonator 8 is disposed in relation to the explosive configuration 10 in such a way that it can detonate the explosive configuration 10 at an ignition point 18, or detonates the explosive configuration 10 in the case of deployment. The ignition point 18 lies at a location remote from the detonator 8 within a casing 20 of the explosive configuration 10. For purposes of illustration, the casing 20 is depicted by dashed lines at a small distance from the explosive configuration 10. The casing 20 encloses both the explosive of the explosive configuration 10 and a recess in the form of an ignition channel 22 incorporated or formed in the explosive. The casing 20 has exclusively concave and planar surface regions and, in particular, does not follow the ignition channel, which leads "into the interior" of the explosive configuration 10. The ignition channel 22 runs from the detonator 8 to the ignition point 18.

The ignition channel 22 is lined by a body 26, in this case a shell in the form of a straight lateral surface of a cylindrical cone, or is surrounded or delimited with respect to the explosive. The body 26 in this case is in an initial form F. The body 26 is a metal body, in this case formed of copper.

FIG. 1 shows an initial state A of the munition 2 or of the munition module 6 or of the explosive configuration 10. In the initial state A, the detonator 8 is not activated or triggered. Consequently, no explosive reaction or the like has begun in the munition 2.

In the initial state A, the ignition channel 22 is open, i.e. a channel from the detonator 8 to the ignition point 18 has been opened up. The ignition channel 22 is constructed in such a way that, starting from the open initial state A, it seals itself in an exploded state S.

In the initial state A, the ignition channel 22 is an unfilled cavity. The detonator 8 is a flyer-forming booster detonator and the ignition channel 22 is a flyer channel for the detonator 8. A lead relay 28 is disposed (indicated by dashed lines) at the end of the ignition channel 22 opposite from the detonator 8. The lead relay 28 serves for the actual detonation of the explosive configuration 10 or its explosive. The flying path of the flyer is symbolized by an arrow.

Figure 1A:
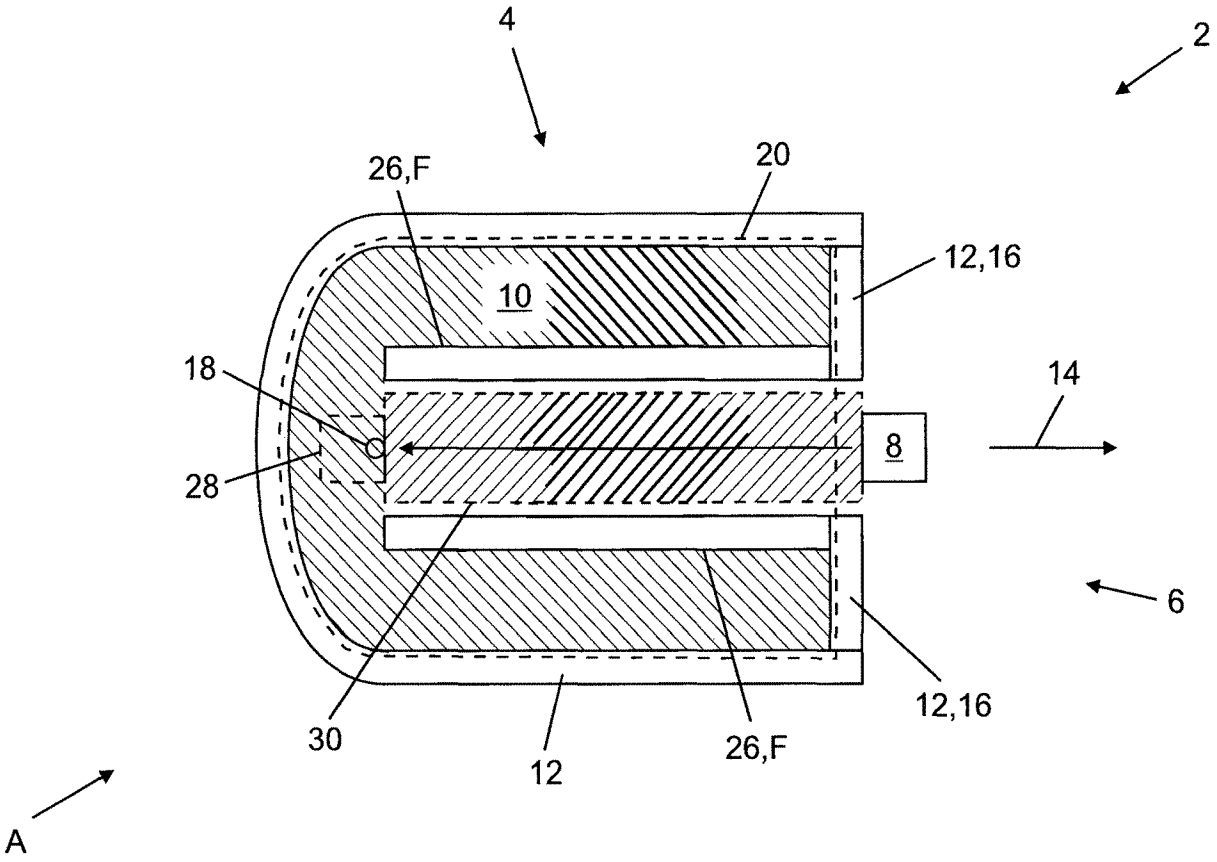
FIG. 1A is a view similar to FIG. 1 in which an alternative pyrotechnic material is placed in an ignition channel.

FIG. 1A alternatively shows an ignition channel 22 that is not an unfilled cavity but instead contains a pyrotechnic material 30 (dashed, hatched). The pyrotechnic material 30 serves in this case for transmitting the detonating information from the detonator 8 to the ignition point 18.

Figure 2:
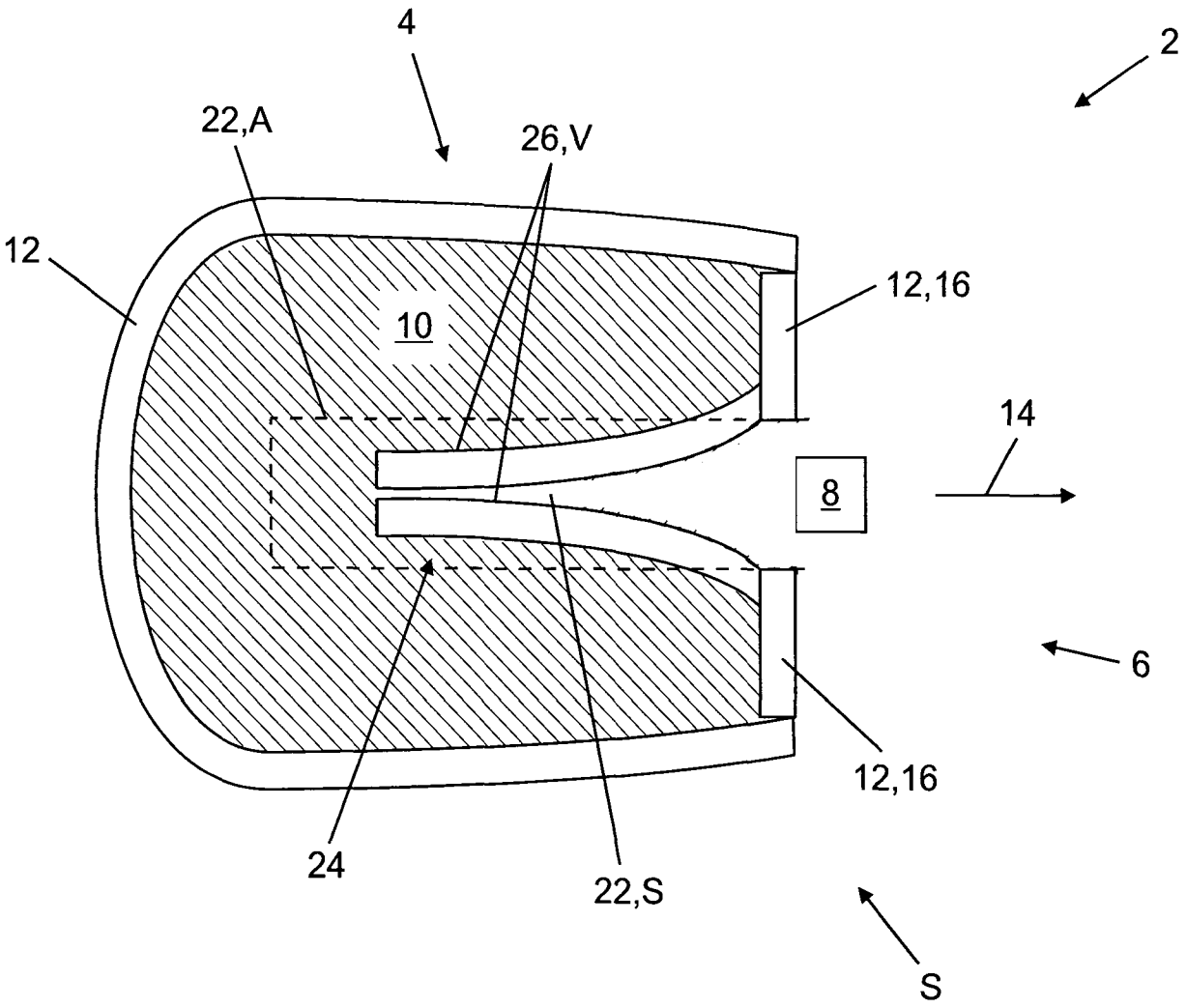
FIG. 2 is a longitudinal-sectional view of the munition of FIG. 1 in an exploded state and FIG. 2A is a view similar to FIG. 2 in which a residual material is formed from the alternative pyrotechnic material.

FIG. 2 shows the munition 2 of FIG. 1 in the exploded state S. The exploded state S exists after detonation of the detonator 8 has taken place. The detonator 8 has already detonated the explosive of the explosive configuration 10 at the ignition point 18. The explosive 10 is in a reaction phase, i.e. at least part of the explosive has already reacted. A shell of the munition 2 that is no longer specifically represented is in any case deformed, but not yet destroyed and still keeps the reacted explosive within the active covering 12.

In the exploded state S, the ignition channel 22 (having its initial state A once again indicated by dashed lines) is at least partially closed by a sealing element 24. The sealing element 24 is introduced into the ignition channel 22 by the at least partially reacted explosive of the explosive configuration 10.

The sealing element 24 is formed in this case by at least part of the body 26, which in the exploded state S has been deformed into a closed form V. A part of the body 26, in this case its compressed end facing the explosion point S, forms the sealing element 24.

Figure 2A:
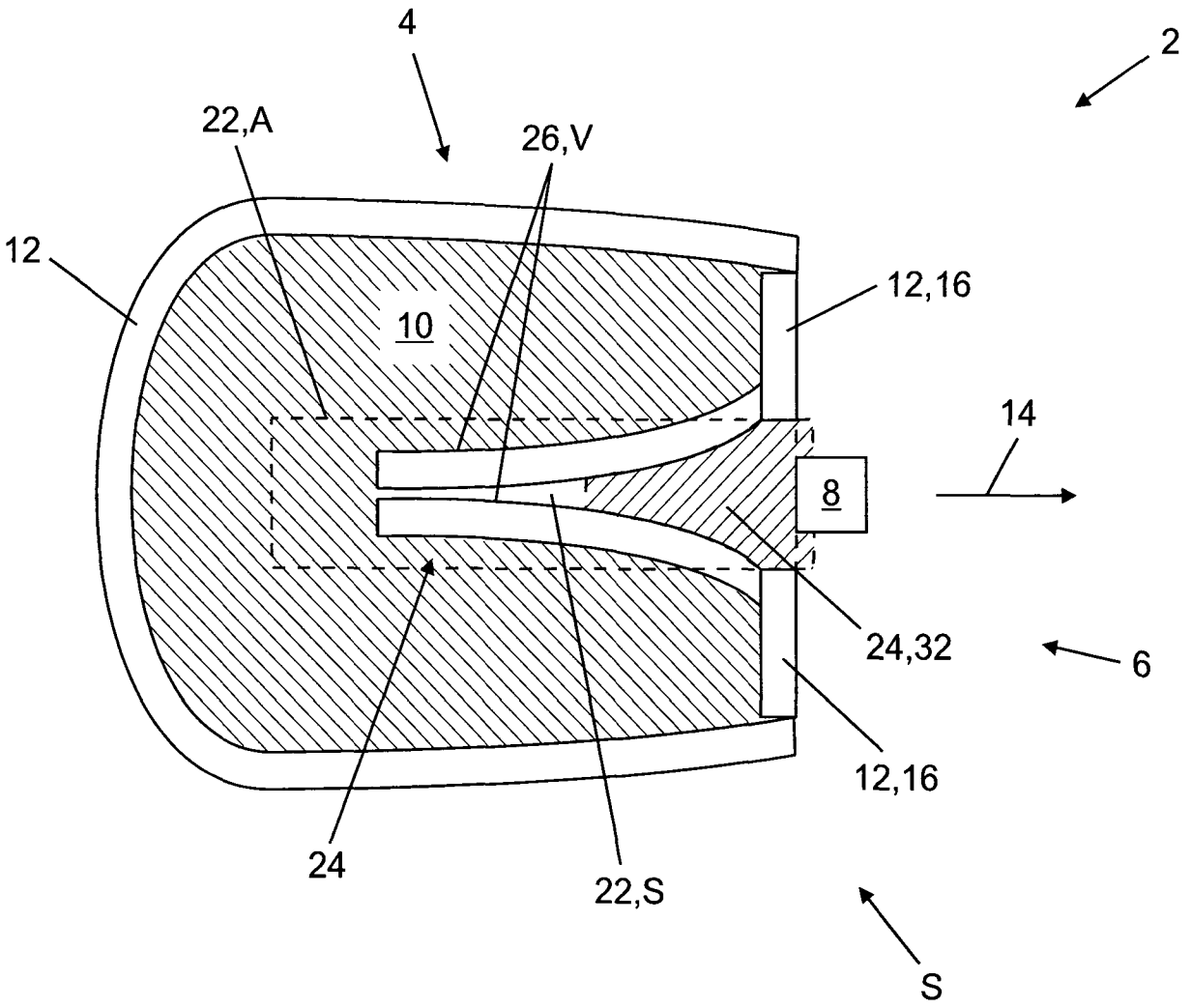

In the alternative embodiment shown in FIG. 2A, after detonation, the pyrotechnic material 30 has been reacted into a residual material 32. This residual material 32 additionally forms a further sealing element 24 and is slag.

The original ignition channel 22 is sealed by the sealing elements 24, so that no, or scarcely any, fumes of the reacted explosive can escape. Therefore, in the situation that is represented in FIG. 2, the entire energy of the reacted explosive is still available for the acceleration of the active covering 12.

Figure 3:
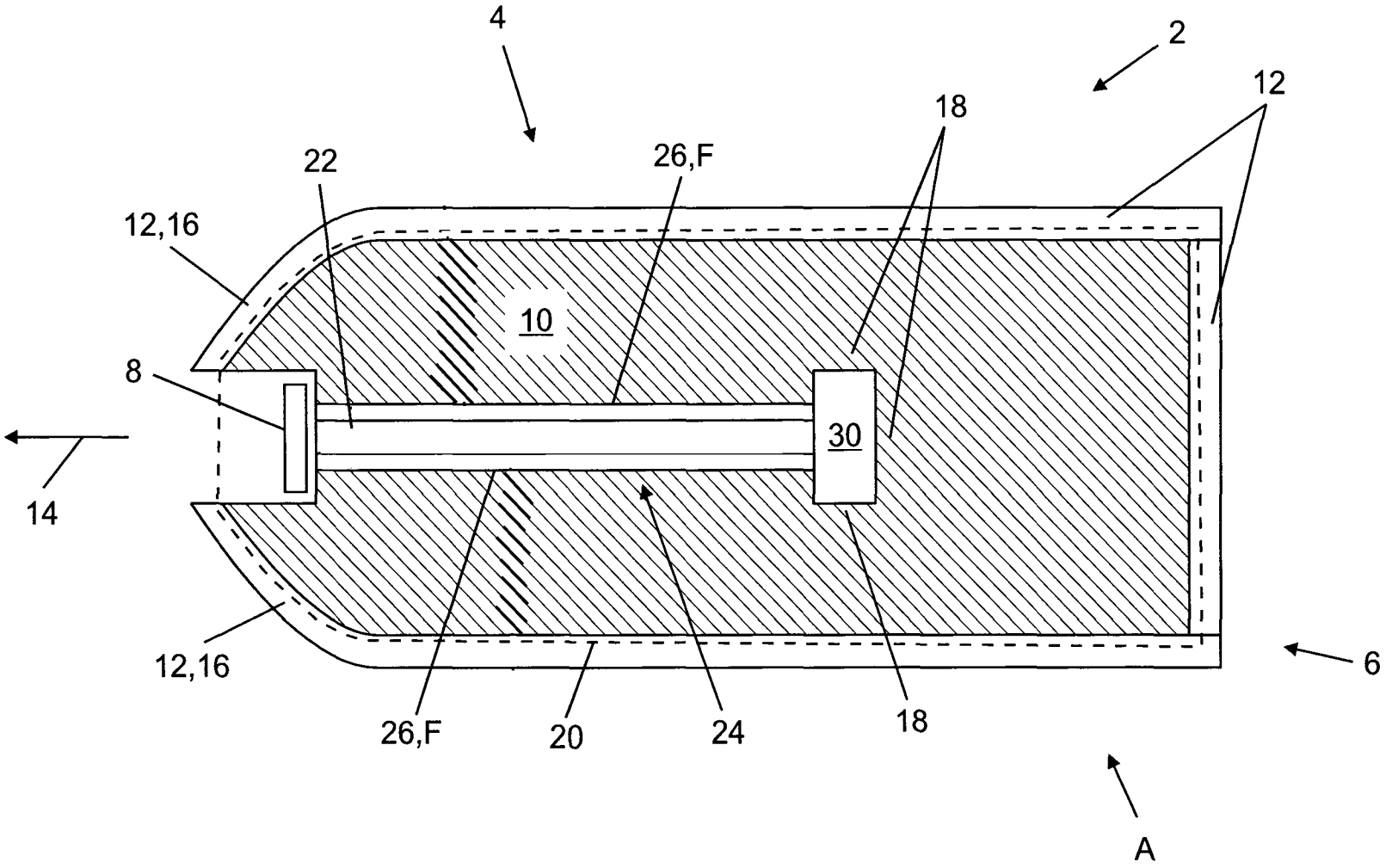
FIG. 3 is a longitudinal-sectional view of an alternative munition indicating an alternative munition concept and FIG. 3A is a view similar to FIG. 3 in which a closed form of a tube is shown in dashed lines.
Figure 3A:
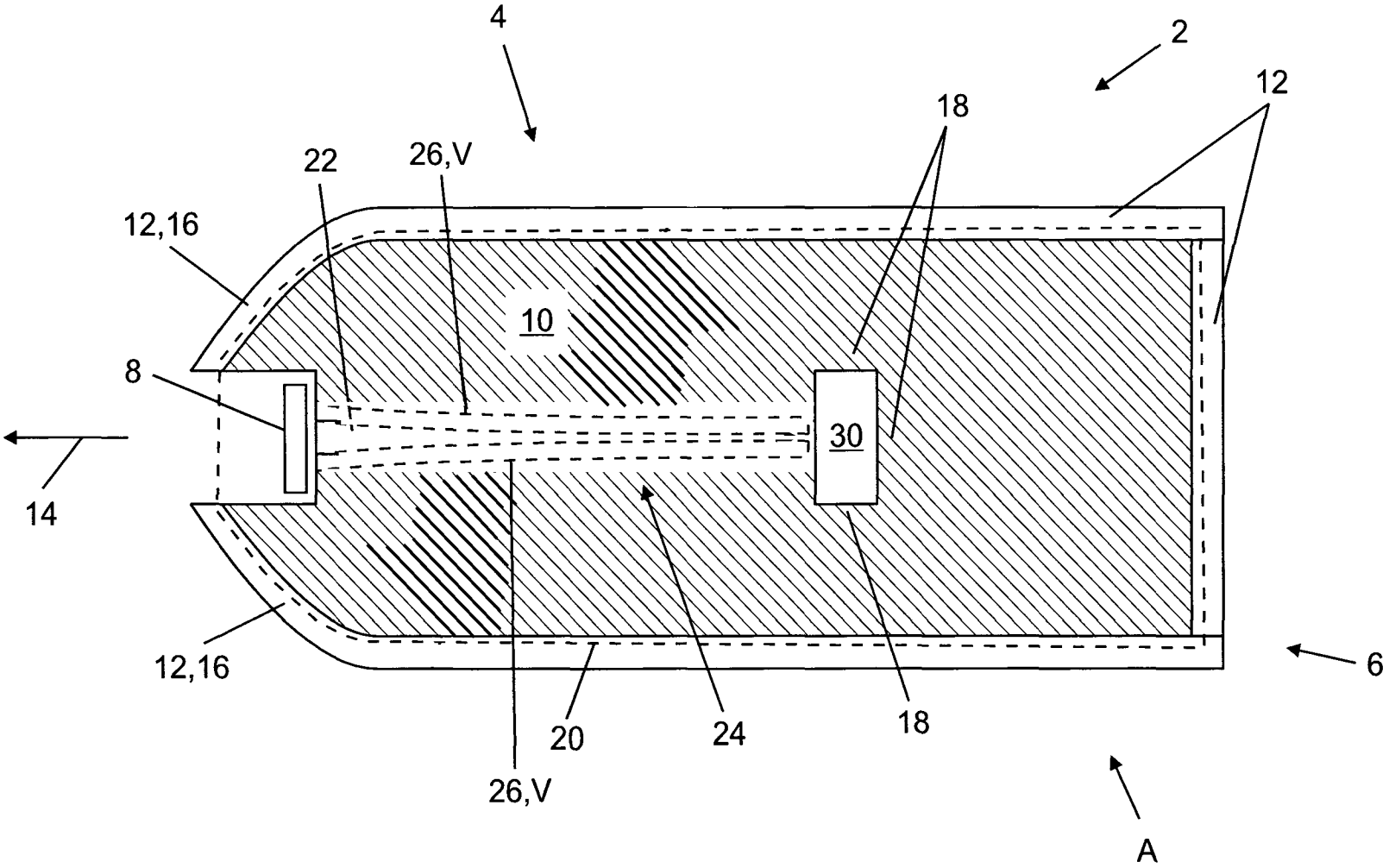

FIG. 3 diagrammatically shows an alternative munition 2, in this case in the form of an air-burst munition, with an alternative warhead 4 having an alternative munition module 6 in the initial state A. In this case, the ignition point 18 lies approximately at the center of the casing 20 of the explosive configuration 10. The detonator 8 is again a flyer-forming booster detonator, which interacts with a lead relay 28. The flying path of the flyer is again symbolized by an arrow. The ignition point 18 is extended in this case and is formed of the explosive surrounding the lead relay or adjoining it. In this case, too, the sealing 24 is formed by a body 26, in this case a copper tube, which surrounds the ignition channel 22 in its initial form F in the manner of a straight lateral surface of a circular cylinder. During the reaction of the explosive configuration 10 in the exploded state, the body 26 is compressed to form the sealing element 24 (represented by dashed lines showing a closed form 26V of the tube in FIG. 3A).

In summary, according to FIG. 2 and FIG. 3 (as indicated by dashed lines), it is evident that the self-sealing of the ignition channel 22 has the effect that the reacting explosive of the explosive configuration 10 can no longer escape, or only slightly, in the form of fumes through the ignition channel 22. The entire explosive energy of the explosive configuration 10 is consequently used for the respective acceleration of all of the active covering 12. Thus, in particular, including the part 16 of the active covering 12 that lies "in front of" the explosive configuration 10, as seen in the direction of the detonator, i.e. on the side of the explosive configuration that is facing the detonator 8.

Consequently, in the case of FIG. 3, a 360-degree effect of the active covering 12, in this case a fragmenting covering, is obtained, and in FIG. 2 in particular a fragmenting effect in the direction of the arrow 14, that is to say in the direction of flight, is obtained.

LIST OF DESIGNATIONS

2 Munition
4 Warhead
6 Munition module
8 Detonator
10 Explosive configuration
12 Active covering
14 Direction of flight
16 Part
18 Ignition point
20 Casing
22 Ignition channel
24 Sealing element
26 Body
28 Lead relay
30 Pyrotechnic material
32 Residual material
A Initial state
S Exploded state
F Initial form
V Closed form

The invention claimed is:

1. A munition module, comprising:
an explosive configuration having a casing;
a detonator for detonating said explosive configuration;
an ignition point positioned at a location remote from said detonator within said casing;
said detonator being disposed relative to said explosive configuration to enable said detonator to ignite said explosive configuration at said ignition point;
an ignition channel surrounded by at least part of said explosive configuration and extending from said detonator to said ignition point in an initial state;
said ignition channel being formed as an open channel in said initial state and being self-sealing in an exploded state occurring after an explosive detonation;
said explosive configuration entirely filling said casing outside of said ignition channel in said initial state before detonation; and
at least one sealing element being introduced into said ignition channel by an at least partially reacted explosive, said at least one sealing element at least partially closing said ignition channel in said exploded state.

2. The munition module according to claim 1, which further comprises a body forming said sealing element, said body having an initial form in said initial state and being deformed into a closed form in said exploded state, and at least part of said deformed body being said sealing element.

3. The munition module according to claim 2, wherein said body is a shell surrounding said ignition channel in said initial form.

4. The munition module according to claim 2, wherein said body is a metal body.

5. The munition module according to claim 2, wherein said ignition channel contains a pyrotechnic material in said initial state, and said pyrotechnic material is converted into a residual material after a detonation of said explosive configuration.

6. The munition module according to claim 5, wherein said sealing element is formed by at least part of said residual material.

7. The munition module according to claim 5, wherein said residual material is slag.

8. A munition module, comprising:
an explosive configuration having a casing;
a detonator for detonating said explosive configuration;
an ignition point positioned at a location remote from said detonator within said casing;
said detonator being disposed relative to said explosive configuration to enable said detonator to ignite said explosive configuration at said ignition point;
an ignition channel surrounded by at least part of said explosive configuration and extending from said detonator to said ignition point in an initial state, said ignition channel being an unfilled cavity in said initial state;

said ignition channel being formed as an open channel in said initial state and being self-sealing in an exploded state occurring after an explosive detonation; and said explosive configuration entirely filling said casing outside of said ignition channel in said initial state before detonation.

9. The munition module according to claim 8, which further comprises a lead relay for detonating said explosive configuration, said lead relay being disposed at an end of said ignition channel opposite from said detonator, said detonator being a flyer-forming booster detonator and said ignition channel being a flyer channel.

10. A warhead, comprising:

a munition module including:

an explosive configuration having a casing;

a detonator for detonating said explosive configuration;

an ignition point positioned at a location remote from said detonator within said casing;

said detonator being disposed relative to said explosive configuration to enable said detonator to ignite said explosive configuration at said ignition point;

an ignition channel surrounded by at least part of said explosive configuration and extending from said detonator to said ignition point in an initial state;

said ignition channel being formed as an open channel in said initial state and being self-sealing in an exploded state occurring after an explosive detonation; and said explosive configuration entirely filling said casing outside of said ignition channel in said initial state before detonation; and an active covering to be accelerated by a reacted explosive, said active covering at least partially surrounding said explosive configuration.

11. The warhead according to claim 10, wherein said active covering is a fragmenting covering.

12. The warhead according to claim 10, wherein said explosive configuration has a side facing said detonator, and at least part of said active covering is provided on said side of said explosive configuration.

13. An air-burst munition, comprising:

a warhead according to claim 10.

14. A munition, comprising:

a warhead including a munition module and an active covering to be accelerated by a reacted explosive;

said munition module including:

an explosive configuration having a casing;

a detonator for detonating said explosive configuration;

an ignition point positioned at a location remote from said detonator within said casing;

said detonator being disposed relative to said explosive configuration to enable said detonator to ignite said explosive configuration at said ignition point;

an ignition channel surrounded by at least part of said explosive configuration and extending from said detonator to said ignition point in an initial state;

said ignition channel being formed as an open channel in said initial state and being self-sealing in an exploded state occurring after an explosive detonation; and said explosive configuration entirely filling said casing outside of said ignition channel in said initial state before detonation;

said active covering of said warhead at least partially surrounding said explosive configuration; and said detonator of said munition module of said warhead being an impact detonator.

* * * * *